US010527033B2

(12) United States Patent
Ezzo et al.

(10) Patent No.: US 10,527,033 B2
(45) Date of Patent: Jan. 7, 2020

(54) ABRASION AND PUNCTURE RESISTANT DIAPHRAGM

(71) Applicant: INGERSOLL-RAND COMPANY, Davidson, NC (US)

(72) Inventors: Mark Anthony Ezzo, Troutman, NC (US); Richard Kenneth Bean, Kannapolis, NC (US)

(73) Assignee: Ingersoll-Rand Company, Davidson, NC (US)

( * ) Notice: Subject to any disclaimer, the term of this patent is extended or adjusted under 35 U.S.C. 154(b) by 20 days.

(21) Appl. No.: 15/807,785

(22) Filed: Nov. 9, 2017

(65) Prior Publication Data

US 2019/0136844 A1 May 9, 2019

(51) Int. Cl.

| | |
|---|---|
| ***F04B 43/00*** | (2006.01) |
| ***F04B 43/02*** | (2006.01) |
| ***F04B 43/073*** | (2006.01) |
| *F04B 43/06* | (2006.01) |

(52) U.S. Cl.

CPC ..... *F04B 43/0054* (2013.01); *F04B 43/02* (2013.01); *F04B 43/0736* (2013.01); *F04B 43/06* (2013.01)

(58) Field of Classification Search

CPC .. F04B 43/0054; F04B 43/026; F04B 43/025; F16J 3/02

USPC ..... 92/103 R, 103 F

See application file for complete search history.

(56) References Cited

U.S. PATENT DOCUMENTS

| | | | | |
|---|---|---|---|---|
| 1,515,702 | A | 11/1924 | Reybold | |
| 2,564,693 | A | 8/1951 | Hornbostel | |
| 3,652,187 | A * | 3/1972 | Loeffler | F04B 43/0736 417/393 |
| 4,837,068 | A | 6/1989 | Martin et al. | |
| 4,950,499 | A | 8/1990 | Martin et al. | |
| 4,989,497 | A | 2/1991 | Lerma | |
| 5,052,276 | A | 10/1991 | Halsey | |
| 5,093,067 | A * | 3/1992 | Gibson | B29C 45/14778 264/257 |
| 5,217,797 | A * | 6/1993 | Knox | B29C 70/086 428/167 |
| 5,996,470 | A | 12/1999 | Eady et al. | |
| 6,067,893 | A | 5/2000 | Drahusz, Jr. | |
| 6,080,685 | A | 6/2000 | Eady | |
| 6,205,907 | B1 | 3/2001 | Douglass | |

(Continued)

FOREIGN PATENT DOCUMENTS

| | | |
|---|---|---|
| CA | 2180413 | 11/1997 |
| EP | 0624729 B1 | 12/1996 |

(Continued)

OTHER PUBLICATIONS

Partial International Search Report dated Feb. 12, 2019; EP 18204744.9; Filing Date Nov. 6, 2018.

*Primary Examiner* — Thomas E Lazo
*Assistant Examiner* — Michael Quandt
(74) *Attorney, Agent, or Firm* — Jones IP Group; Wayne A. Jones

(57) ABSTRACT

A diaphragm for use in a pump is provided. The diaphragm includes a flexible disc-shaped body having a first surface and an outer edge. The flexible disc-shaped body is made of an elastomer material. The fabric is applied on the first surface of the flexible disc-shaped body. And the fabric is composed of woven aramid based fibers.

20 Claims, 4 Drawing Sheets

(56) References Cited

U.S. PATENT DOCUMENTS

| | | | | |
|---|---|---|---|---|
| 6,722,262 | B2 * | 4/2004 | Ball | F15B 15/10<br>92/103 F |
| 8,567,303 | B2 | 10/2013 | Ingersoll et al. | |
| 2005/0126390 | A1 | 6/2005 | Fortin et al. | |
| 2014/0163158 | A1 | 6/2014 | Terada et al. | |
| 2015/0017364 | A1 | 1/2015 | Ota et al. | |
| 2015/0098837 | A1 | 4/2015 | Seith et al. | |

FOREIGN PATENT DOCUMENTS

| | | | |
|---|---|---|---|
| EP | 898076 | A1 | 2/1999 |
| EP | 1956242 | B1 | 4/2011 |
| EP | 10310 713 | B1 | 9/2011 |

* cited by examiner

ABRASION AND PUNCTURE RESISTANT DIAPHRAGM

TECHNICAL FIELD AND SUMMARY

The present disclosure relates to pumps such as diaphragm pumps. Particularly, the present disclosure relates to a diaphragm used in such diaphragm pumps, wherein the diaphragm is a composite of a flexible elastomer diaphragm body with a woven high strength fabric layer applied on top to resist possible abrasion or puncture to the diaphragm body.

Pumps that move fluid from one location to another location such as diaphragm pumps, for example, are known. These pumps typically include one or more flexible diaphragms. A diaphragm is linearly moved in one direction to draw in fluid from a fluid source. The diaphragm then moves in the opposite direction to push that fluid out to another location. By repeatedly moving the diaphragm back and forth, fluid is consistently drawn into and pushed out of the pump. Typically, the fluid is moved through a fluid chamber that houses the diaphragm between inlet and outlet manifolds.

Typical diaphragms used in such pumps like an air operated double diaphragm (AODD) pump are made from thermoplastic or synthetic elastomers. They are sufficiently flexible and durable to help draw in and push out fluid to and from the pump. That said, because of the different types of fluid that are pumped through the pump, the diaphragm may be susceptible to wear or damage. In some environments, for example, the diaphragms may move chemicals that might attack the elastomer material. Polytetrafluoroethylene (PTFE) can, therefore, be added to the diaphragm to serve as a protective component. In some instances, however, the fluid may contain physical objects that could impact the diaphragm. Pumping fluid that contains various media and solids such as chicken bones or ceramics/inorganic particles creates diaphragm abrasion and puncture failures because of the diaphragm's soft flexible material. A thermoplastic polyurethane (TPU) may be used to provide some resistance to abrasion, but, even there, the material has limitations and is not impervious to punctures.

An illustrative embodiment of the present disclosure provides a diaphragm pump. The diaphragm pump comprises an inlet; a fluid chamber in fluid communication with the inlet; an outlet in fluid communication with the fluid chamber; wherein the fluid chamber includes a first portion and a second portion; wherein fluid from a fluid source moves through the first portion of the fluid chamber; a diaphragm located in the fluid chamber; wherein the diaphragm separates the first portion of the fluid chamber from the second portion of the fluid chamber; wherein the diaphragm is a flexible disc-shaped structure made from an elastomer material; wherein the diaphragm has an outer edge configured to be held by the fluid chamber; wherein the diaphragm includes a first surface that faces the first portion of the fluid chamber and a second surface that faces the second portion of the fluid chamber; and a fabric applied on the first surface of the diaphragm facing the first portion of the fluid chamber so the fabric faces the fluid that is moved through the first portion of the fluid chamber; wherein the fabric serves as a barrier between the first portion of the fluid chamber and the diaphragm; and wherein the fabric is composed of woven aramid based fibers.

In the above and other illustrative embodiments, the diaphragm pump may further comprise: wherein the fabric being applied to the first surface of the diaphragm by a means selected from the group consisting of chemical bonding, chemical adhesion, over molding the diaphragm, an adhesive, mechanical fastener, and the diaphragm back-molded onto the fabric via injection or compression molding; the diaphragm pump being a double diaphragm pump; the diaphragm being made of a polyamide; the fabric being applied on the diaphragm such that the elastomer of the diaphragm is located in openings formed between fibers of the fabric; and the diaphragm being made of a poly ether block amide or other materials that have bonding capability with aramid based materials; the diaphragm including an opening disposed through the diaphragm to couple to a motive source that reciprocally moves the diaphragm alternately towards the first portion and away from the second portion.

Another illustrative embodiment of the present disclosure provides a diaphragm pump. The diaphragm pump comprises a fluid chamber; a diaphragm located in the fluid chamber; wherein the diaphragm is a flexible disc-shaped structure made from an elastomer material; wherein the diaphragm has an outer edge; wherein the diaphragm includes a first surface; and a fabric that is applied on the first surface of the diaphragm; wherein the fabric is composed of woven aramid based fibers.

In the above and other illustrative embodiments, the diaphragm pump may further comprise: an inlet, the fluid chamber in fluid communication with the inlet, and an outlet in fluid communication with the fluid chamber; the fluid chamber including a first portion and a second portion, and wherein fluid from a fluid source moves through the first portion of the fluid chamber; the diaphragm separating the first portion of the fluid chamber from the second portion of the fluid chamber; the diaphragm having an outer edge configured to be held by the fluid chamber; the first surface of the diaphragm facing the first portion of the fluid chamber and the diaphragm includes a second surface facing the second portion of the fluid chamber; the diaphragm, including an opening disposed through the diaphragm and the fabric, is applied onto the diaphragm about the opening; the fabric being applied onto the first surface of the diaphragm facing the first portion so the fabric faces the fluid that is moved through the first portion of the fluid chamber; and the fabric serves as a barrier between the first portion of the fluid chamber and the diaphragm.

Another illustrative embodiment of the present disclosure provides a diaphragm for use in a pump. The diaphragm comprises a flexible disc-shaped body having a first surface and an outer edge; wherein the flexible disc-shaped body is made of an elastomer material; and a fabric applied on the first surface of the flexible disc-shaped body; and wherein the fabric is composed of woven aramid based fibers.

In the above and other illustrative embodiments, the diaphragm pump may further comprise: the fabric being applied to the first surface of the diaphragm by a means selected from the group consisting of chemical bonding, chemical adhesion, over molding the diaphragm, an adhesive, mechanical fastener, and the diaphragm back-molded onto the fabric via injection or compression molding; the diaphragm being made of a material selected from the group consisting of polyamide and a poly ether block amide or other materials that have bonding capability with aramid based materials; and the fabric being applied onto the diaphragm such that the elastomer of the diaphragm is located in openings formed between fibers of the fabric.

Additional features and advantages of the diaphragm will become apparent to those skilled in the art upon consideration of the following detailed description of the illustrated embodiments exemplifying best modes of carrying out the diaphragm as presently perceived.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels may be repeated among the figures to indicate corresponding or analogous elements.

Corresponding reference characters indicate corresponding parts throughout the several views. The exemplification set out herein, illustrates embodiments of the diaphragm and such exemplification is not to be construed as limiting the scope of the diaphragm in any manner.

DETAILED DESCRIPTION OF THE DRAWINGS

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

Accordingly, an illustrative embodiment of the present disclosure provides a composite diaphragm structure for use in a diaphragm pump. The composite diaphragm is such that the fluid contact side has an abrasion and puncture resistant layer to guard against these failure modes. In a further embodiment of the present disclosure, the composite diaphragm may include a first diaphragm body layer that is made from an elastomer such as a polyamide and a second layer made of a woven fabric of para-aramid, meta-aramid, poly paraphenylene terephthalamide, or any other aramid based fibers, commonly known as Kevlar. The fabric may be applied and conformed to the size and shape of the elastomer diaphragm body. This ensures the puncture and abrasion resistance characteristics do not interfere with the shape of the diaphragm to allow it to operate in the pump. In another illustrative embodiment, the fibers of the fabric layer may be made from ultra high molecular weight polyethylene (UHMWPE) bonded to a diaphragm made from polyethylene-based elastomer.

Figure 1:
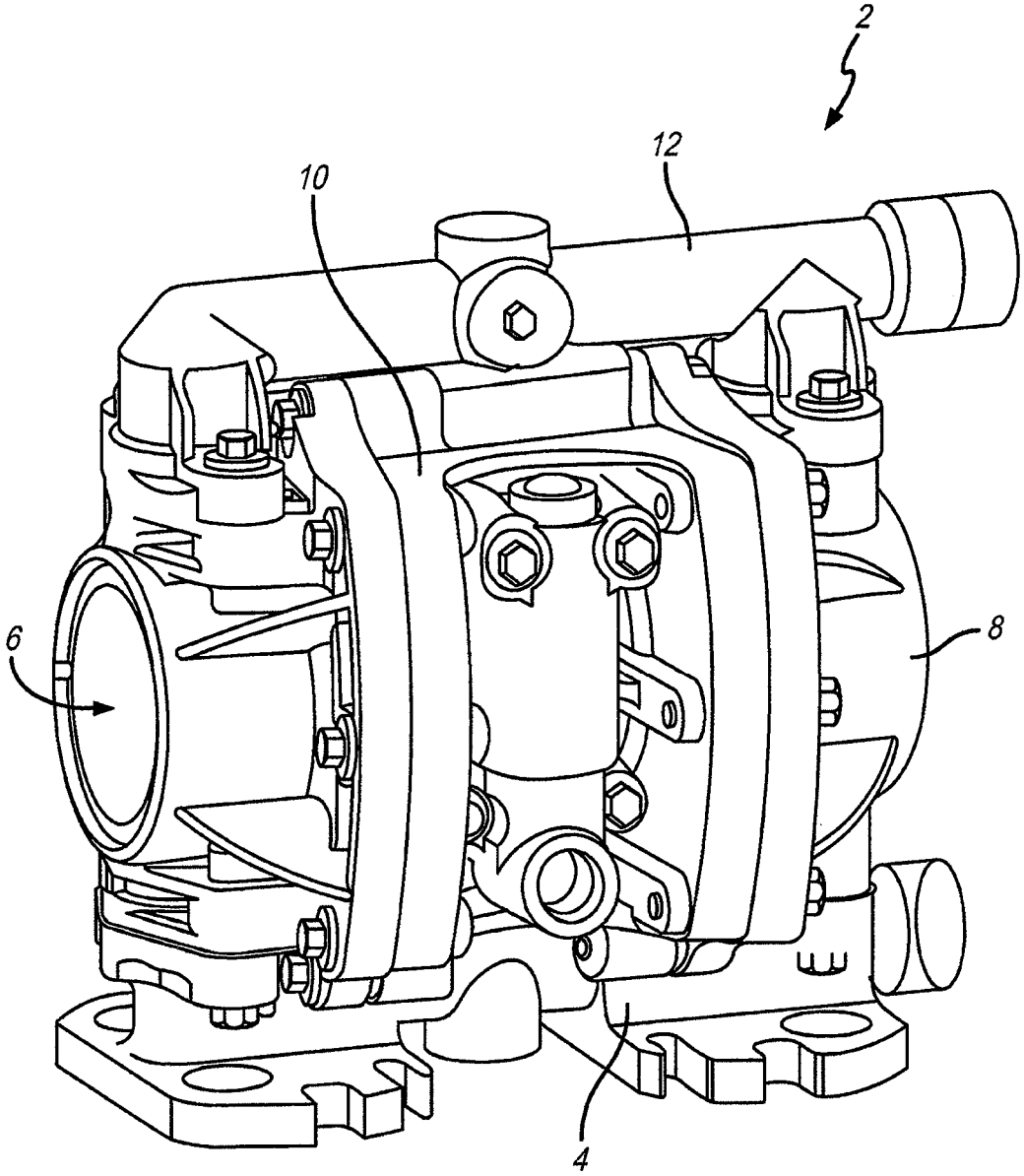
FIG. 1 is a prospective view of an illustrative double diaphragm pump.

A perspective view of an illustrative double diaphragm pump 2 is shown in FIG. 1. It is appreciated that either a single diaphragm or double diaphragm pump may employ the composite diaphragm of the present disclosure. Also, air operated, electric operated, or other means to drive the diaphragm may be employed as well. The skilled artisan, upon reading the present disclosure, will appreciate that the double diaphragm pump shown herein is for illustrative purposes. To that end, the illustrative double diaphragm pump 2 shown includes an inlet manifold 4, first and second fluid chambers 6 and 8, a drive mechanism 10, and an outlet manifold 12. A diaphragm, such as diaphragm 14 shown in FIG. 2, is fitted into each of fluid chambers 6 and 8 and moves fluid from inlet manifold 4 to outlet manifold 12 as known by those skilled in the art.

Figure 2:
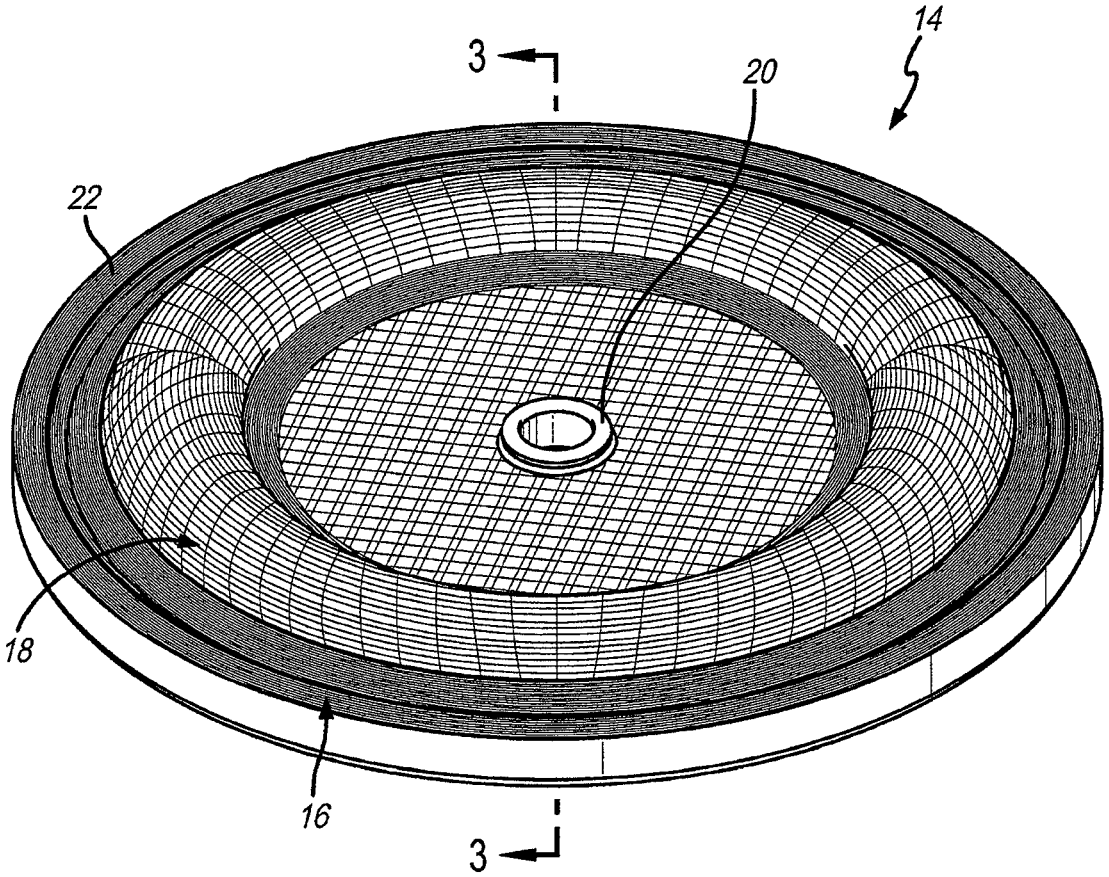
FIG. 2 is a prospective view of an illustrative embodiment of an abrasion and puncture resistant diagram for use in a pump such as that shown in FIG. 1.

A perspective view of an illustrative embodiment of an abrasion and puncture resistant diaphragm 14 is shown in FIG. 2. It is appreciated that the shape and configuration of diaphragm 14 is illustrative. Other shapes and contours employed for pump diaphragms may be employed and are contemplated to be part of this disclosure. With respect to the illustrated embodiment, diaphragm 14 is composed of a base layer 16 that forms the structural body of the diaphragm as shown. It is appreciated that base layer 16 may be made of a compatible thermoplastic elastomer such as a poly ether block amide, thermoplastic vulcinizate (TPV) i.e., Santoprene with polyamide or Zeotherm alkyl acrylate copolymer (ACM) rubber plus polyamide, polyamide elastomers i.e., polyamide 12-block poly(tetramethylene ether) glycol (PTMEG), and polyamide based silicones. Top fabric layer 18 is a flexible Kevlar fabric that is applied onto base layer 16. Being flexible, the Kevlar of top layer 18 will conform to the shape of base layer 16. It is appreciated, that the Kevlar fabric of top layer 18 will be on the fluid-contact side of the diaphragm. This means that top layer 18 will be exposed to the fluid being pumped in from a fluid source through inlet manifold 4 and pumped out to outlet manifold 12 (see, also, FIG. 1). It is this fluid that may contain media or other solids that has the potential to cause damage to the diaphragm. The Kevlar fabric of top layer 18 protects against that damage. It is also appreciated that the Kevlar may have chemical resistance to a wide range of chemicals which might help it in other applications—even where media and solids do not pose a risk.

Also shown in this view is neck 20 and rim 22 of diaphragm 14. In the illustrated embodiment, neck 20 provides the structural support to engage a washer, fastener, or both, etc., that secures to the moving piston rod, screw, etc., that generates the reciprocal movement of diaphragm 14. (See, also, FIG. 5). Similarly, rim 22 is the structural portion of diaphragm 14 that is held in place by the pump housing and fluid chamber head to keep the diaphragm in position and maintain a seal between the fluid chamber and the air or other motive fluid chamber that typical diaphragms segregate. It is appreciated that neither neck 20 or rim 22 necessarily require the Kevlar fabric of top layer 18. It will be appreciated by the skilled artisan upon reading this disclosure; however, that if deemed necessary because of the nature of the pump and/or the fluids being moved therethrough, top layer 18 may be applied to these structures as well.

Figure 3:
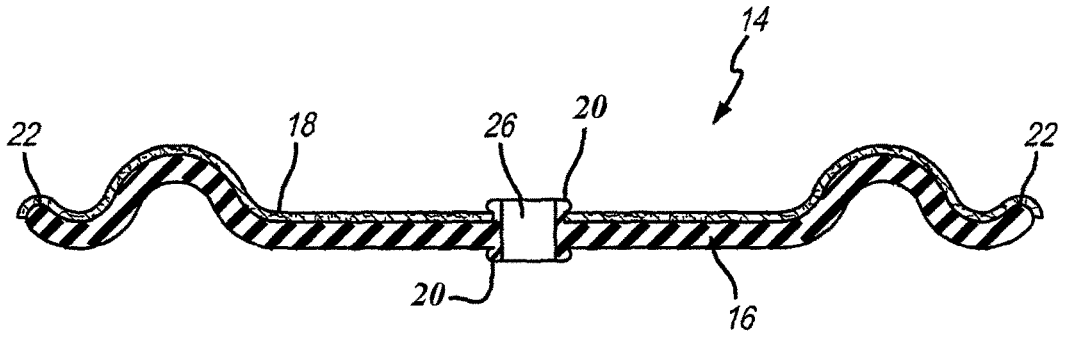
FIG. 3 is a side cross-sectional view of the diaphragm of FIG. 2.

A cross-sectional view of diaphragm 14 is shown in FIG. 3. This view further demonstrates how top layer 18 is laminated onto base layer 16. The skilled artisan will appreciate upon reading this disclosure that the fabric of top layer 18 may be applied to base layer 16 by such means as chemical bonding, chemical adhesion, or over molding with top layer 18. Alternatively, top layer 18 may be applied via adhesive or even a mechanical fastener. Still, alternatively, the diaphragm body that makes up base layer 16 may be back-molded into the fabric of top layer 18 via injection or compression molding. Further, alternatively, the elastomer of the diaphragm may migrate between the woven fibers of top layer 18 to further reinforce attachment of top layer 18 onto base layer 16.

Also shown in this view is top layer 18 applied over rim 22 of base layer 16. As further shown herein in FIG. 5, rim 22 is configured to assist securing diaphragm 14 to the fluid chamber. It will be appreciated by the skilled artisan upon reading this disclosure that depending on the characteristics of the pump, the diaphragm, and how the same is held in the fluid chamber, top layer 18 may or may not extend over rim 22 of base layer 16. In the illustrative embodiment, top layer 18 extends over rim 22 of base layer 16. But depending on the attachment characteristics, it may be advantageous for the fabric of top layer 18 not to extend over rim 22 in other embodiments. As such, the fabric of top layer 18 may be backed-off to expose base layer 16 at rim 22.

Figure 4:
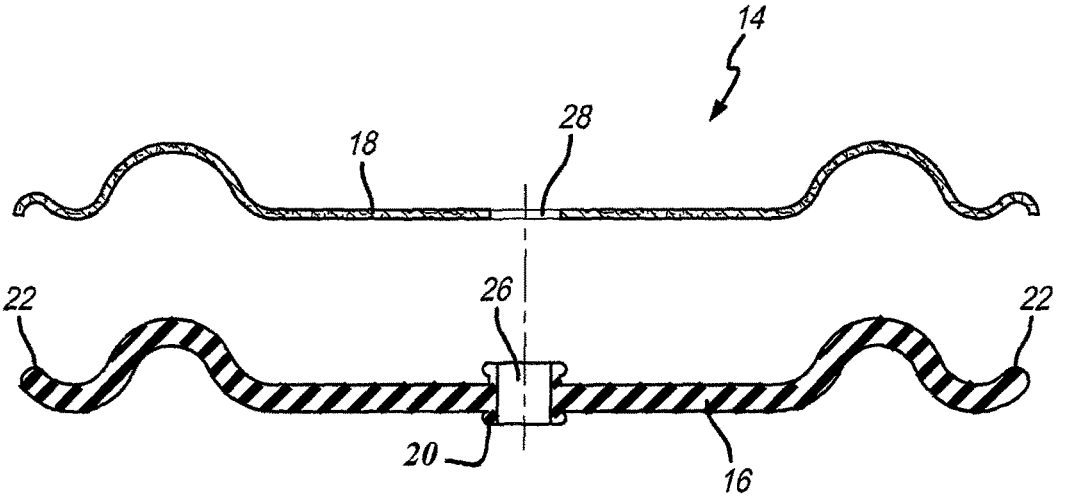
FIG. 4 is a side cross-sectional exploded view of the diaphragm of FIG. 2.

A cross-sectional exploded view of diaphragm 14 is shown in FIG. 4. This view demonstrates how top layer 18 is a separate Kevlar fabric layer distinguishable from the diaphragm structure body of base layer 16. Again, the Kevlar fabric of top layer 18 is designed to withstand puncture and abrasion forces that may be applied to the diaphragm of base layer 16 when drawing in or pushing out fluid. It is further appreciated that top layer 18 is flexible enough to move with base layer 16 as diaphragm 14 is being pushed back and forth by a motive means creating the pumping action. Also shown in this view is neck 20 that surrounds bore 26 that receives a fastener or other structure to further secure diaphragm 14 onto the pump motive mechanism. Coincident with bore 26 is opening 28 disposed through the Kevlar fabric of top layer 18 and is present for the same purposes.

Figure 5:
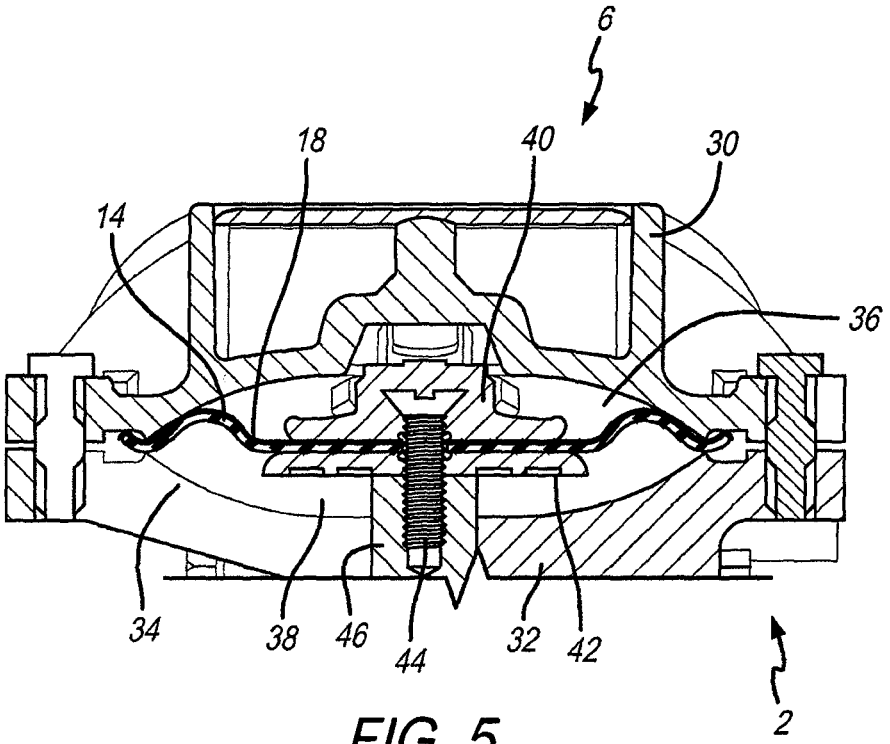
FIG. 5 is a side cross-sectional view of a fluid chamber portion of the diaphragm pump of FIG. 1 showing the diaphragm of FIGS. 2 through 4 installed therein.

A detailed cross dissection view of a portion of double diaphragm pump 2 is shown in FIG. 5. In particular, this view depicts the fluid chamber 6 portion of double diaphragm pump 2. Illustratively, a pump head 30 couples to a base 32 that forms fluid chamber cavity 34. Diaphragm 14 segregates fluid chamber cavity 34 into a pumped fluid-side portion 36 and non-pumped fluid-side portion 38. The pumped fluid-side portion 36 is the side where fluid being received through inlet manifold 4 enters fluid chamber 6 due to the movement of diaphragm 14. Hence, this is the side that requires top layer 18 since it is here the diaphragm will be susceptible to solids and other media that might otherwise damage diaphragm 14. Non-pumped fluid-side 38 may be used to receive motive fluid such as air or hydraulic fluid which assists moving diaphragm 14 to draw in and push out the fluid.

Also shown in this view are washers 40 and 42 which sandwich diaphragm 14. Fastener 44 secures washers 40 and 42 onto diaphragm 14. In addition, fastener 44 secures those structures to a rod 46 which is either tied to another spaced apart diaphragm mechanism located in another fluid chambers (such as fluid chamber 8 shown in double diaphragm pump 2 and FIG. 2), or a motor or other structure to move diaphragm 14.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

The invention claimed is:

1. A diaphragm pump comprising:

an inlet;

a fluid chamber in fluid communication with the inlet; an outlet in fluid communication with the fluid chamber;

wherein the fluid chamber includes a first portion and a second portion;

wherein fluid from a fluid source moves through the first portion of the fluid chamber;

a diaphragm located in the fluid chamber;

wherein the diaphragm separates the first portion of the fluid chamber from the second portion of the fluid chamber;

wherein the diaphragm is a flexible disc-shaped structure made from an elastomer material;

wherein the diaphragm has an outer edge configured to be held by the fluid chamber;

wherein the diaphragm includes a first surface that faces the first portion of the fluid chamber and a second surface that faces the second portion of the fluid chamber; and a fabric applied on the first surface of the diaphragm facing the first portion of the fluid chamber so the fabric faces the fluid that is moved through the first portion of the fluid chamber;

wherein the fabric serves as a barrier between the first portion of the fluid chamber and the diaphragm;

wherein the fabric is composed of woven aramid based fibers; and wherein the fabric is applied to the first surface of the diaphragm by a means selected from the group consisting of chemical bonding, chemical adhesion, over molding the diaphragm and an adhesive.

2. The diaphragm pump of claim 1, wherein the diaphragm pump is a double diaphragm pump.

3. The diaphragm pump of claim 1, wherein the diaphragm is made of a polyamide.

4. The diaphragm pump of claim 1, wherein the fabric is applied on the diaphragm such that the elastomer of the diaphragm is located in openings formed between fibers of the fabric.

5. The diaphragm pump of claim 1, wherein the diaphragm is made of a poly ether block amide.

6. The diaphragm pump of claim 1, wherein the diaphragm includes an opening disposed through the diaphragm to couple to a motive source that reciprocally moves the diaphragm alternately towards the first portion and away from the second portion.

7. The diaphragm pump of claim 1 wherein the diaphragm is made from an elastomer material selected from the group consisting of poly ether block amide, thermoplastic vulcanizate, and polyamide based silicones.

8. A diaphragm pump comprising:

a fluid chamber;

a diaphragm located in the fluid chamber;

wherein the diaphragm is a flexible disc-shaped structure made from an elastomer material;

wherein the diaphragm has an outer edge;

wherein the diaphragm includes a first surface; and a fabric that is applied on the first surface of the diaphragm; wherein the fabric is composed of woven aramid based fibers; and wherein the fabric is applied to the first surface of the diaphragm by a means selected from the group consisting of chemical bonding, chemical adhesion, overmolding the diaphragm, and an adhesive.

9. The diaphragm pump of claim 8, wherein the diaphragm pump further comprises an inlet, the fluid chamber in fluid communication with the inlet, and an outlet in fluid communication with the fluid chamber.

10. The diaphragm pump of claim 8, wherein the fluid chamber includes a first portion and a second portion, and wherein fluid from a fluid source moves through the first portion of the fluid chamber.

11. The diaphragm pump of claim 10, wherein the diaphragm separates the first portion of the fluid chamber from the second portion of the fluid chamber.

12. The diaphragm pump of claim 11, wherein the first surface of the diaphragm faces the first portion of the fluid chamber and the diaphragm includes a second surface that faces the second portion of the fluid chamber.

13. The diaphragm pump of claim 12, wherein the fabric is applied onto the first surface of the diaphragm facing the first portion so the fabric faces the fluid that is moved through the first portion of the fluid chamber.

14. The diaphragm pump of claim 10, wherein the fabric serves as a barrier between the first portion of the fluid chamber and the diaphragm.

15. The diaphragm pump of claim 8, wherein the diaphragm has an outer edge configured to be held by the fluid chamber.

16. The diaphragm pump of claim 8, wherein the diaphragm includes an opening disposed through the diaphragm and the fabric is applied onto the diaphragm about the opening.

17. The diaphragm pump of claim 8 wherein the diaphragm is made of a material selected from the group consisting of polyamide and a poly ether block amide.

18. A diaphragm for use in a pump for pumping fluid wherein the diaphragm has a fluid contact side when used in the pump, the diaphragm comprising:

a flexible disc-shaped body having a first surface and an outer edge; wherein the disc-shaped flexible body is made of an elastomer material;

a fabric applied on the first surface of the disc-shaped flexible body; and wherein the fabric is composed of woven aramid based fibers that have been applied to the first surface by a means selected from the group consisting of chemical bonding, chemical adhesion, over molding the diaphragm, and an adhesive;

wherein the fabric on the first surface is exposed to the pumped fluid on the fluid contact side; and wherein the elastomer comprises a poly ether block amide.

19. The diaphragm pump of claim 18, wherein the diaphragm is made of a material selected from the group consisting of polyamide and a poly ether block amide.

20. The diaphragm pump of claim 18, wherein the fabric is applied onto the diaphragm such that the elastomer of the diaphragm is located in openings formed between fibers of the fabric.

* * * * *